US009672778B2

(12) United States Patent
Lim et al.

(10) Patent No.: US 9,672,778 B2
(45) Date of Patent: Jun. 6, 2017

(54) METHOD OF DRIVING DISPLAY PANEL AND DISPLAY APPARATUS FOR PERFORMING THE SAME

(71) Applicant: Samsung Display Co., Ltd., Yongin, Gyeonggi-Do (KR)

(72) Inventors: Woon-Yong Lim, Busan (KR); Ki-Hyun Pyun, Gwangmyeong-si (KR); Bong-Kyun Jo, Hwaseong-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 40 days.

(21) Appl. No.: 14/618,898

(22) Filed: Feb. 10, 2015

(65) Prior Publication Data

US 2016/0005380 A1 Jan. 7, 2016

(30) Foreign Application Priority Data

Jul. 7, 2014 (KR) ..... 10-2014-0084285

(51) Int. Cl.
*G09G 5/10* (2006.01)
*G09G 3/36* (2006.01)

(52) U.S. Cl.
CPC ... *G09G 3/3614* (2013.01); *G09G 2300/0452* (2013.01); *G09G 2320/064* (2013.01); *G09G 2320/0666* (2013.01); *G09G 2370/08* (2013.01)

(58) Field of Classification Search
None
See application file for complete search history.

(56) References Cited

U.S. PATENT DOCUMENTS

2008/0278466 A1* 11/2008 Joo ..... G09G 3/3614 345/205
2014/0085288 A1* 3/2014 Choi ..... G09G 3/3614 345/212
2015/0379947 A1* 12/2015 Sang ..... G09G 3/3614 349/37

FOREIGN PATENT DOCUMENTS

KR 10-2004-0023241 3/2004
KR 10-2006-0067291 6/2006
KR 10-2008-0085255 9/2008
KR 10-2013-0074374 7/2013
KR 1020140079573 * 6/2014 ..... G09G 3/36

* cited by examiner

*Primary Examiner* — Joseph Haley
*Assistant Examiner* — Ifedayo Iluyomade
(74) *Attorney, Agent, or Firm* — Robert E. Bushnell, Esq.

(57) ABSTRACT

A method of driving a display panel includes steps of generating a plurality of load signals, of which at least one load signal has a different timing from the rest of the load signals, generating data voltages synchronized to low periods of the load signals and outputting the data voltages to data lines. Accordingly, the data voltages synchronized to each of the load signals can be outputted to each of the data lines. A color coordinate problem occurring when applying a RGBW type may be solved by setting a charging time of a white sub-pixel different from the rest of the sub-pixels. Thus, display quality of a display apparatus including the display panel may be improved.

20 Claims, 5 Drawing Sheets

METHOD OF DRIVING DISPLAY PANEL AND DISPLAY APPARATUS FOR PERFORMING THE SAME

CLAIM OF PRIORITY

This application makes reference to, incorporates the same herein, and claims all benefits accruing under 35 U.S.C. §119 from an application earlier filed in the Korean Intellectual Property Office on 7 Jul. 2014 and there duly assigned Serial No. 10-2014-0084285.

BACKGROUND OF THE INVENTION

Field of the Invention

Exemplary embodiments of the present inventive concept relate to a method of driving a display panel and a display apparatus for performing the method. More particularly, exemplary embodiments of the present inventive concept relate to a method of driving a display panel using multiplexed load signals so that charging times of data voltages may vary depending on a sub-pixel, and a display apparatus for performing the method.

Description of the Related Art

Generally, a display apparatus includes a display panel displaying an image and a panel driver for driving the display panel. The display panel includes a plurality of gate lines, a plurality of data lines and a plurality of sub-pixels connected to the gate lines and the data lines.

The panel driver generates a gate signal and a data voltage. The gate line transmits the gate signal to the sub-pixel, and the data line transmits the data voltage to the sub-pixel. In a conventional method, a load signal, which is known as TP signal, controls a charging time of the data voltage has a same timing for all data lines. Thus, the charging time of the data voltage of each sub-pixel is same for all data lines.

Recently, a display apparatus of RGBW type has been developed for improving Luminance, light efficiency and reducing power consumption. The display apparatus of RGBW type converts image data for 3 colors to image data for 4 colors, and displays an image based on the image data with a red, a green, a blue and a white sub-pixel respectively.

A color coordinate of the white sub-pixel is different from color coordinates of the red, green and blue sub-pixels because the color coordinate of the white sub-pixel depends on a color coordinate of a backlight unit in the display apparatus of RGBW type.

The above information disclosed in this Background section is only for enhancement of understanding of the background of the invention and therefore it may contain information that does not form the prior art that is already known in this country to a person of ordinary skill in the art.

SUMMARY OF THE INVENTION

Exemplary embodiments of the present inventive concept provide a method of driving a display panel that improves display quality.

Exemplary embodiments of the present inventive concept also provide a display apparatus performing the method of driving the display panel.

An exemplary embodiment of the present inventive concept provides a method of driving a display panel. According to the method, a plurality of load signals are generated. The load signals include a plurality of low periods such that at least one load signal has a different timing from the rest of the load signals. Data voltages synchronized to the low periods of the load signals are generated. The data voltages are outputted to data lines.

In an exemplary embodiment, the display panel comprises red, green, blue and white sub-pixels.

In an exemplary embodiment, the low periods include a first low period corresponding to the red sub-pixel, a second low period corresponding to the green sub-pixel, a third low period corresponding to the blue sub-pixel, and a fourth low period corresponding to the white sub-pixel. The fourth low period is shorter than the second low period.

In an exemplary embodiment, the fourth low period is shorter than the first low period. The second low period is longer than the first low period, and the third low period has a same length as the first period.

In an exemplary embodiment, the display panel includes a first data line alternately connected to the red sub-pixel and the blue sub-pixel along a first direction and a second data line alternately connected to the green sub-pixel and the white sub-pixel along the first direction and adjacent to the first data line.

In an exemplary embodiment, a first load signal corresponding to the first data line includes a first low period corresponding to the red sub-pixel and a third low period corresponding to the blue sub-pixel and having a same length as the first period. A second load signal corresponding to the second data line includes a second low period corresponding to the green sub-pixel and a fourth low period corresponding to the white sub-pixel and being shorter than the second low period.

In an exemplary embodiment, the display panel further includes a third data line alternately connected to the red sub-pixel and the blue sub-pixel along the first direction and adjacent to the second data line and a fourth data line alternately connected to the green sub-pixel and the white sub-pixel along the first direction and adjacent to the third data line, a top of the second data line is connected to the green sub-pixel and a top of the fourth data line is connected to the white sub-pixel.

In an exemplary embodiment, data voltages for the first data line and the third data line are synchronized with a first load signal. Data voltages for the second data line are synchronized with a second load signal. Data voltages for the fourth data line are synchronized with a third load signal. The first load signal, the second load signal and the third load signal have different timings from one another.

In an exemplary embodiment, a first period between a first pulse of the first load signal and a second pulse of the first load signal is shorter than a second period between a first pulse of the second load signal and a second pulse of the second load signal. The first period is longer than a third period between a first pulse of the third load signal and a second pulse of the third load signal.

A display apparatus according to an exemplary embodiment of the present inventive concept includes a display panel, a timing controller and a data driver. The display panel includes a plurality of gate lines, a plurality of data lines and a plurality of sub-pixels and displays an image. The timing controller generates a plurality of load signals including a plurality of low periods. At least one load signal has a different timing from the rest of the load signals. The data driver generates data voltages synchronized to the low periods of the load signals and outputs the data voltages to the data lines.

In an exemplary embodiment, the display panel comprises red, green, blue and white sub-pixels.

In an exemplary embodiment, the low periods include a first low period corresponding to the red sub-pixel, a second low period corresponding to the green sub-pixel, a third low period corresponding to the blue sub-pixel, and a fourth low period corresponding to the white sub-pixel. The fourth low period is shorter than the second low period.

In an exemplary embodiment, the fourth low period is shorter than the first low period. The second low period is longer than the first low period, and the third low period has a same length as the first period.

In an exemplary embodiment, the display panel includes a first data line alternately connected to the red sub-pixel and the blue sub-pixel along a first direction and a second data line alternately connected to the green sub-pixel and the white sub-pixel along the first direction and adjacent to the first data line.

In an exemplary embodiment, a first load signal corresponding to the first data line includes a first low period corresponding to the red sub-pixel and a third low period corresponding to the blue sub-pixel and having a same length as the first period. A second load signal corresponding to the second data line includes a second low period corresponding to the green sub-pixel and a fourth low period corresponding to the white sub-pixel and being shorter than the second low period.

In an exemplary embodiment, the display panel further includes a third data line alternately connected to the red sub-pixel and the blue sub-pixel along the first direction and adjacent to the second data line and a fourth data line alternately connected to the green sub-pixel and the white sub-pixel along the first direction and adjacent to the third data line, a top of the second data line is connected to the green sub-pixel and a top of the fourth data line is connected to the white sub-pixel.

In an exemplary embodiment, data voltages for the first data line and the third data line are synchronized with a first load signal. Data voltages for the second data line are synchronized with a second load signal. Data voltages for the fourth data line are synchronized with a third load signal. The first load signal, the second load signal and the third load signal have different timings from one another.

In an exemplary embodiment, a first period between a first pulse of the first load signal and a second pulse of the first load signal is shorter than a second period between a first pulse of the second load signal and a second pulse of the second load signal. The first period is longer than a third period between a first pulse of the third load signal and a second pulse of the third load signal.

According to the method of driving the display panel and the display apparatus for performing the method, by using multiplex load signals in a display apparatus of RGBW type, a charging time of a data voltage of a white sub-pixel is reduced and a charging time of a data voltage of a green sub-pixel is increased so that difference between one of a red, a green and a blue sub-pixel and a white sub-pixel may be reduced without a great loss of luminance of whole panel.

In addition, no additional signal generation is required because charging time of sub-pixel is controlled only by controlling the load signal.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF EMBODIMENTS

Hereinafter, the present inventive concept will be explained in detail with reference to the accompanying drawings.

Figure 1:
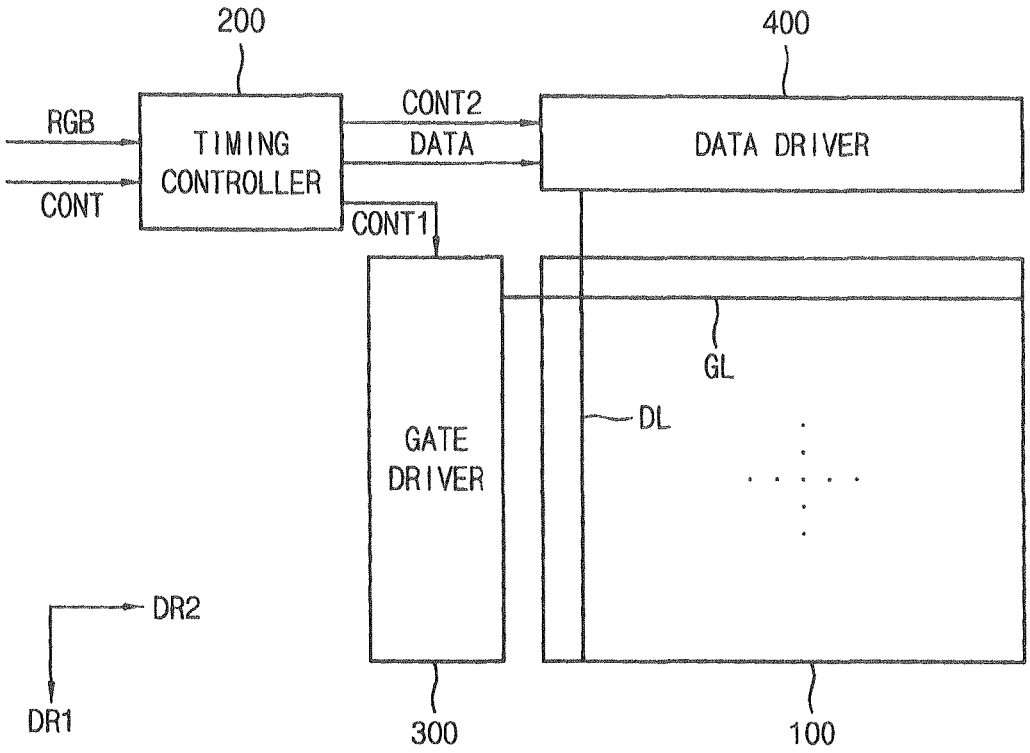
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, and a data driver 400.

The display panel 100 displays an image. The display panel 100 includes a display region for displaying an image and a peripheral region adjacent to the display region.

The display panel 100 includes a plurality of gate lines GL, a plurality of data lines DL and a plurality of sub-pixels connected to the gate lines GL and the data lines DL. The gate lines GL extend in a second direction DR2 and the data lines DL extend in a first direction DR1 crossing the second direction DR2.

The display panel 100 may include a first sub-pixel having a first color, a second sub-pixel having a second color, a third sub-pixel having a third color and a fourth sub-pixel having a fourth color. The first to the fourth sub-pixel may form a pixel unit.

The sub-pixels include a switching element (not shown), a liquid crystal capacitor (not shown) and a storage capacitor (not shown). The liquid crystal capacitor and the storage capacitor are electrically connected to the switching element. The sub-pixels may be arranged in a matrix configuration.

The timing controller 200 receives input image data RGB and an input control signal CONT from an external device (not shown). The input image data RGB may include red image data, green image data and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2 and a data signal DATA based on the input image data RGB and the input control signal CONT.

The timing controller 200 generates the first control signal CONT1 for controlling operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling operation of the data driver 400 based on the input control signal CONT, and outputs the second control signal CONT2 to the data driver 400. The second control signal CONT2 may include a horizontal start signal and a load signal.

The second control signal CONT2 may include a plurality of load signals. At least one load signal may have a different timing from the rest of the load signals.

The timing controller 200 generates the data signal DATA based on the input image data RGB. The timing controller 200 outputs the data signal DATA to the data driver 400.

The gate driver 300 generates gate signals for driving the gate lines GL in response to the first control signal CONT1 received from the timing controller 200. The gate driver 300 sequentially outputs the gate signals to the gate lines GL. The gate driver 300 may be directly mounted on the display panel 100, or may be connected to the display panel 100 as a tape carrier package (TCP) type. Alternatively, the gate driver 300 may be integrated on the peripheral region of the display panel 100.

The data driver 400 receives the second control signal CONT2 and the data signal DATA from the timing controller 200. The data driver 400 outputs data voltages to the data lines DL.

Figure 2:
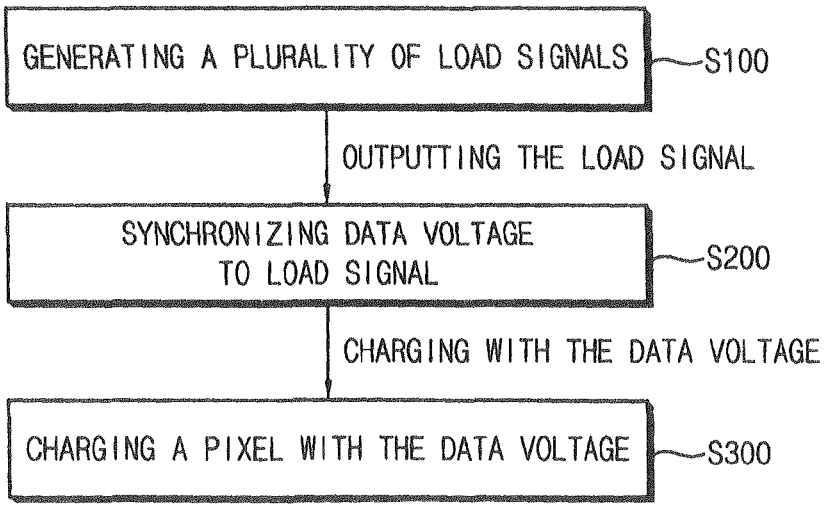
FIG. 2 is a flowchart illustrating a method of driving a display panel, which is performed by the timing controller and the data driver of FIG. 1.

FIG. 2 is a flowchart illustrating a method of driving a display panel, which is performed by the timing controller and the data driver of FIG. 1.

Referring to FIGS. 1 and 2, the second control signal CONT2 generated by the timing controller 200 may include the load signals (S100). The timing controller 200 outputs the load signals to the data driver 400. At least one load signal has a different timing from the rest of the load signals.

The data driver 400 generates data voltages synchronized to low periods of the outputted load signals (S200). The data driver 400 outputs the data voltages to data lines DL.

The data lines DL are connected to the first to the fourth sub-pixels. The outputted data voltage is charged to the sub-pixel connected to the data line DL during pulse duration of the outputted data voltage (S300).

Figure 3:
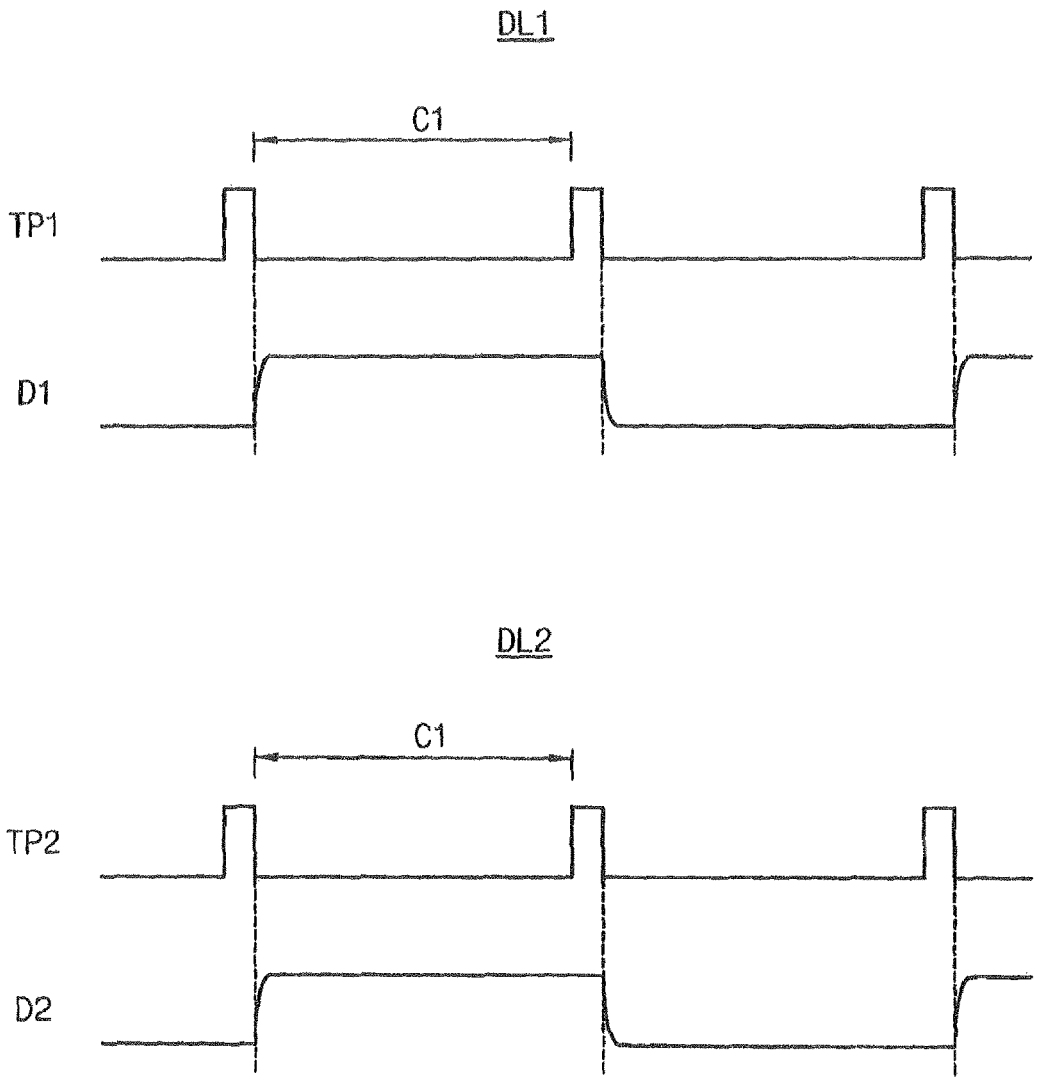
FIG. 3 is a waveform diagram illustrating driving signals synchronized to load signals.

FIG. 3 is a waveform diagram illustrating driving signals synchronized to load signals.

Referring to FIG. 3, load signals are periodically repeated square waves. The data driver 400 generates a first data voltage D1 and a second data voltage D2 based on the first and second load signals TP1 and TP2, and outputs the first and second data voltages D1 and D2 to a first data line DL1 and a second data line DL2, respectively. The first and second data voltages D1 and D2 are synchronized to the first and second load signals TP1 and TP2. For example, the first and second data voltages D1 and D2 are synchronized to falling edges of the first and second load signals TP1 and TP2.

Each of the first and second data voltages D1 and D2 may be outputted continuously. For example, the first data voltage D1 for a first sub-pixel is outputted in response to a first falling edge of the first load signal TP1, and a next first data voltage for a second sub-pixel neighboring to the first sub-pixel and connected to the first data line DL1 is outputted continuously without blank period in response to a second falling edge of the first load signal TP1.

In a conventional method, the first load signal TP1 for the first data line DL1 has a low period C1 having a same length as a low period of the second load signal TP2 for the second data line DL2. Thus, each of sub-pixels has a same charging time. However, different load signals may be applied for the data lines according to an exemplary embodiment.

Figure 4:
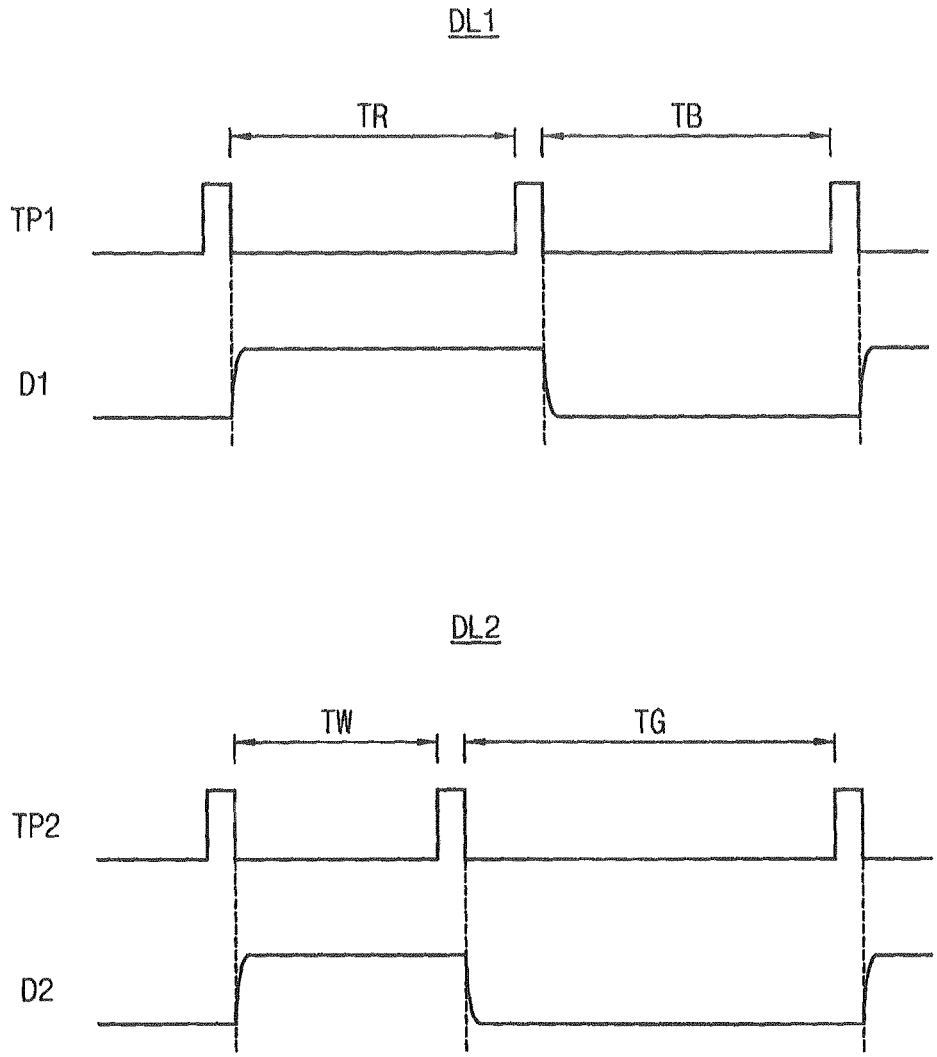
FIG. 4 is a waveform diagram illustrating driving signals for the data lines of FIG. 1.

FIG. 4 is a waveform diagram illustrating driving signals for the data lines of FIG. 1.

Referring to FIG. 4, load signals are periodically repeated square waves. The data driver 400 generates a first data voltage D1 based on a first load signal TP1. The first data voltage D1 is synchronized to the first load signal TP1. The data driver 400 generates a second data voltage D2 based on a second load signal TP2. The second data voltage D2 is synchronized to the second load signal TP2. For example, the first data voltage D1 is synchronized to a falling edge of the first load signal TP1, and the second data voltage D2 is synchronized to a falling edge of the second load signal TP2.

Figure 5:
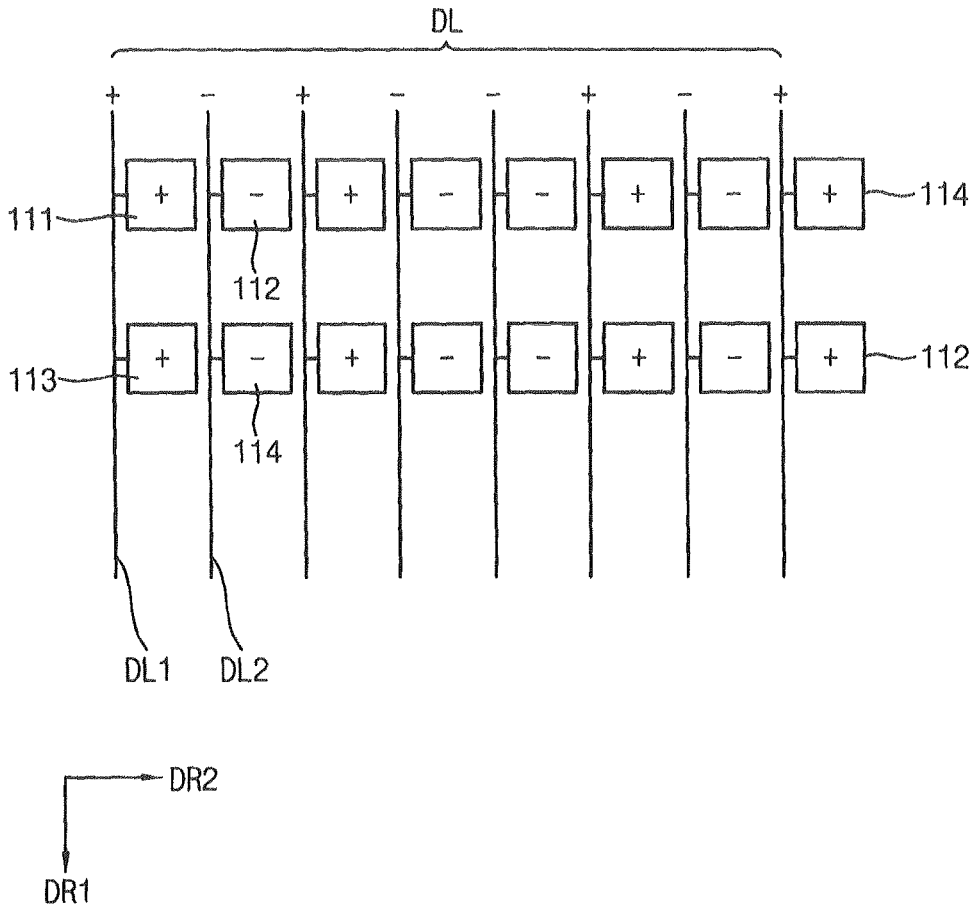
FIG. 5 is a plan view illustrating the display panel of FIG. 1.

The data driver 400 outputs the synchronized data voltages D1 and D2 to data lines DL1 and DL2 of FIG. 5.

Thus, the first and second data voltages D1 and D2 respectively synchronized to the first and second load signal TP1 and TP2 different from each other is outputted according to the exemplary embodiment of the present inventive concept.

FIG. 5 is a plan view illustrating the display panel of FIG. 1.

Referring to FIG. 5, the display panel includes a plurality of data lines DL, a plurality of gate lines GL and a plurality of sub-pixels 111, 112, 113 and 114.

The display panel may include a first sub-pixel having a first color, a second sub-pixel having a second color, a third sub-pixel having a third color and a fourth sub-pixel having a fourth color.

For example, the first to the third sub-pixels may be a red sub-pixel, a green sub-pixel and a blue sub-pixel. The first sub-pixel 111 may be a red sub-pixel. The second sub-pixel 112 may be a green sub-pixel. The third sub-pixel 113 may be a blue sub-pixel.

For example, the fourth sub-pixel 114 may be a white sub-pixel. Alternatively, the fourth sub-pixel may be one of cyan, magenta and yellow sub-pixel.

The display panel includes a first data line DL1 alternately connected to the first sub-pixel 111 and the third sub-pixel 113 and a second data line DL2 alternately connected to the second sub-pixel 112 and the fourth sub-pixel 114. The second data line DL2 may be adjacent to the first data line DL1.

When data voltages synchronized to the same load signal are outputted to the first and second data lines DL1 and DL2 as illustrated in FIG. 3 in the display apparatus of RGBW type illustrated in FIG. 5, charging times of the data voltages of the first sub-pixel 111, the second sub-pixel 112 and the third sub-pixel 113 are the same as a charging time of the data voltage of the fourth sub-pixel 114. Accordingly, a color coordinate difference between the first to the third sub-pixel 111, 112 and 113 and the fourth sub-pixel 114 occurs because of loss of transmittance of the first to the third sub-pixels 111, 112 and 113.

Thus, data voltages synchronized to different load signals are outputted to data lines in an exemplary embodiment. For example, the first and second data voltages D1 and D2 respectively synchronized to the first and second load signals TP1 and TP2 different from each other are outputted to the first and second data lines DL1 and DL2, as illustrated in FIG. 4, in the display apparatus of RGBW type illustrated in FIG. 5. The first load signal TP1 includes a first low period TR for the first sub-pixel 111, and a third low period for the third sub-pixel 113. The second load signal TP2 includes a second low period TG for the second sub-pixel 112, and a fourth low period TW for the fourth sub-pixel 114. The fourth low period TW corresponding to the fourth sub-pixel 114 may be shorter than the second low period TG corresponding to the second sub-pixel 112. The fourth low period TW corresponding to the fourth sub-pixel 114 may be shorter than the first low period TR corresponding to the first sub-pixel 111. The first low period TR corresponding to the first sub-pixel 111 may be same as the third low period TB corresponding to the third sub-pixel 113. The second low period TG corresponding to the second sub-pixel 112 may be longer than the first low period TR corresponding to the first sub-pixel 111.

In the display panel of RGBW type, a color coordinate of the fourth sub-pixel 114 may be different from color coordinates of the first to the third sub-pixel 111, 112 and 113 because the color coordinate of the fourth sub-pixel 114 depends on a color coordinate of a backlight unit. A charging time of the fourth sub-pixel 114, of which the color coordinate cannot be controlled by the timing controller 200, may be reduced, because the fourth low period TW is shorter than the first to the third low periods TR, TG and TB. Thus, the affect caused by the fourth sub-pixel on the color coordinate for an entire image may be reduced.

In addition, a color coordinate of the display panel 100 can be easily controlled by increasing a charging time of the second sub-pixel most influential to the color coordinate of the entire image, because the second low period TG is longer than the first, the third and the fourth low period TR, TB and TW.

Figure 6:
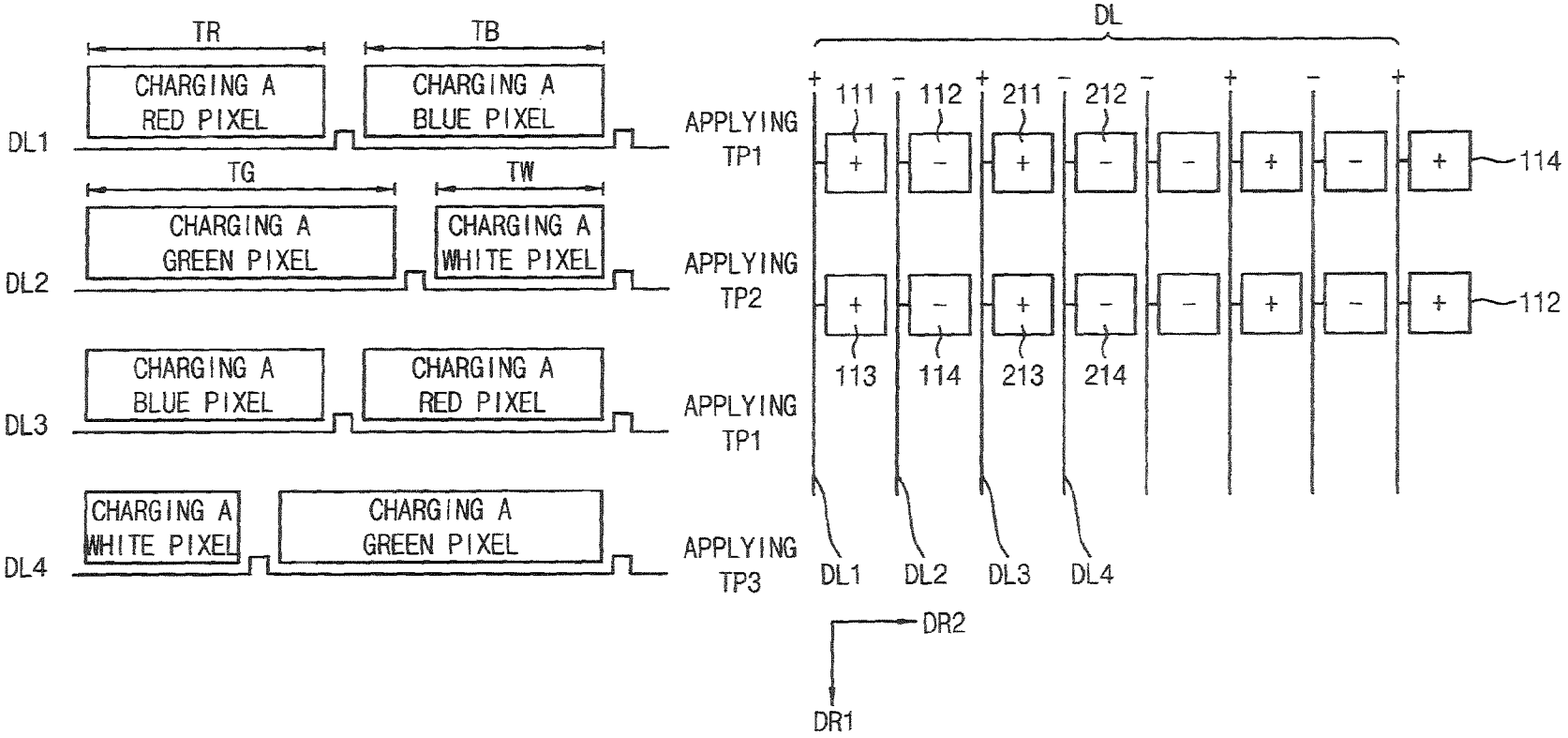
FIG. 6 is a waveform diagram illustrating the driving signals outputted to the data lines of the display panel of FIG. 5.

According to an exemplary embodiment of the present inventive concept, a data driver outputs data voltages synchronized to different load signals TP1, TP2 and TP3 to data lines DL1, DL2, DL3 and DL4, as illustrated in FIG. 6.

FIG. 6 is a waveform diagram illustrating the driving signals outputted to the data lines of the display panel of FIG. 5.

Referring to FIGS. 5 and 6, the display panel includes a first and a second data line. The first data line DL1 may be alternately connected to the first sub-pixel 111 and the third sub-pixel 113 along the first direction DR1. The second data line DL2 may be alternately connected to the second sub-pixel 112 and the fourth sub-pixel 114 along the first direction DR1. The second data line DL2 may be adjacent to the first data line DL1.

A second load signal TP2 corresponding to the second data line DL2 may have a fourth low period TW corresponding to the fourth sub-pixel 114 and a second low period TG corresponding to the second sub-pixel that is longer than the fourth low period TW. A first load signal TP1 corresponding to the first data line DL1 may have a first low period TR corresponding to the first sub-pixel 111 and a third low period TB corresponding to the third sub-pixel that is the same as the first low period TR.

The display panel may further include a third and a fourth data line. The third data line DL3 may be alternately connected to a fifth sub-pixel 211 and a seventh sub-pixel 213 along the first direction DR1. The fourth data line DL4 may be alternately connected to a sixth sub-pixel 212 and an eighth sub-pixel 214 along the first direction DR1. The fifth sub-pixel 211 has a same color as the third sub-pixel 113, the sixth sub-pixel 212 has a same color as the fourth sub-pixel 114, the seventh sub-pixel 213 has a same color as the first sub-pixel 111, and the eighth sub-pixel 214 has a same color as the second sub-pixel 112. The first, the second, the third and the fourth data line may be sequentially disposed along the second direction DR2. A top of the third data line DL3 is connected to the fifth sub-pixel 211. A top of the fourth data line DL4 is connected to the sixth sub-pixel 212. Thus, the first sub-pixel 111 having the first color, the second sub-pixel 112 having the second color, the fifth sub-pixel 211 having the third color and the sixth sub-pixel 212 having the fourth color are disposed in a same row.

The first to the third sub-pixel may be a red sub-pixel, a green sub-pixel and a blue sub-pixel. The first sub-pixel may be a red sub-pixel. The second sub-pixel may be a green sub-pixel. The third sub-pixel may be a blue sub-pixel.

The fourth sub-pixel may be a white sub-pixel. Alternatively, the fourth sub-pixel may be one of cyan, magenta and yellow sub-pixel.

A data voltage synchronized to a first load signal TP1 is outputted to the first data line DL1 and the third data line DL3, a data voltage synchronized to a second load signal TP2 is outputted to the second data line DL2, and a data voltage synchronized to a third load signal TP3 is outputted to the fourth data line DL4.

The first load signal TP1, the second load signal TP2 and the third load signal TP3 may have different timings from each other.

The first load signal TP1 includes a first period TR between a first pulse and a second pulse, and a third period TB between the second pulse and a third pulse, for respectively charging the first sub-pixel 111 and the third sub-pixel 113. The first load signal TP1 is further applied for charging the seventh sub-pixel 213 and the fifth sub-pixel 211, which are connected to the third data line DL3. The second load signal TP2 includes a second period TG between a first pulse and a second pulse, and a fourth period TW between the second pulse and a third pulse, for respectively charging the second sub-pixel 112 and the fourth sub-pixel 114. The third load signal TP3 includes a fifth period between a first pulse and a second pulse, and a sixth period between the second pulse and a third pulse, for respectively charging the sixth sub-pixel 212 and the eighth sub-pixel 214. The fifth period is substantially same as the fourth period TW, and the sixth period is substantially same as the second period TG. The first period TR may be same as the third period TB. The first period TR is shorter than the second period TG. The first period TR is longer than the fourth period TW.

A period between the first pulse and the third pulse may be same for each of the data lines.

According to the present inventive concept as explained above, multiplexed load signals are used in the display apparatus of RGBW type. Thus, a charging time of a data voltage of a white sub-pixel is reduced and a charging time of a data voltage of a green sub-pixel is increased. Thus, color coordinate difference due to a white sub-pixel may be reduced without substantial loss of luminance. Thus, a display quality can be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims.

What is claimed is:

1. A method of driving a display panel including a first color sub-pixel, a second color sub-pixel, a third color sub-pixel and a white sub-pixel, the first to the third color sub-pixels having different colors from each other, the method comprising:

generating a plurality of load signals including a plurality of low periods such that a load signal for the white sub-pixel has a different timing from at least one of the load signals for the first to the third color sub-pixels;

generating data voltages synchronized to the low periods of the load signals; and outputting the data voltages to data lines.

2. The method of claim 1, wherein the first, the second and the third color sub-pixels are respectively red, green and blue sub-pixels, wherein the low periods include a first low period corresponding to the red sub-pixel, a second low period corresponding to the green sub-pixel, a third low period corresponding to the blue sub-pixel, and a fourth low period corresponding to the white sub-pixel, and the fourth low period is shorter than the second low period.

3. The method of claim 2, wherein the fourth low period is shorter than the first low period, and the second low period is longer than the first low period, and the third low period has a same length as the first period.

4. The method of claim 1, wherein the first, the second and the third color sub-pixels are respectively red, green and blue sub-pixels, wherein the display panel comprises a first data line alternately connected to the red sub-pixel and the blue sub-pixel along a first direction; and a second data line alternately connected to the green sub-pixel and the white sub-pixel along the first direction and adjacent to the first data line, wherein a first load signal corresponding to the first data line has a first low period corresponding to the red sub-pixel and a third low period corresponding to the blue sub-pixel and having a same length as the first period, and a second load signal corresponding to the second data line has a second low period corresponding to the green sub-pixel and a fourth low period corresponding to the white sub-pixel and being shorter than the second low period.

5. The method of claim 1, wherein the first, the second and the third color sub-pixels are respectively red, green and blue sub-pixels, wherein the display panel comprises a first data line alternately connected to the red sub-pixel and the blue sub-pixel along a first direction; and a second data line alternately connected to the green sub-pixel and the white sub-pixel along the first direction and adjacent to the first data line;

a third data line alternately connected to the red sub-pixel and the blue sub-pixel along the first direction and adjacent to the second data line and a fourth data line alternately connected to the green sub-pixel and the white sub-pixel along the first direction and adjacent to the third data line, a top of the second data line is connected to the green sub-pixel, and a top of the fourth data line is connected to the white sub-pixel, wherein data voltages for the first data line and the third data line are synchronized with a first load signal, data voltages for the second data line are synchronized with a second load signal, data voltages for the fourth data line are synchronized with a third load signal, and the first load signal, the second load signal and the third load signal have different timings from one another.

6. The method of claim 5, wherein a first period between a first pulse of the first load signal and a second pulse of the first load signal is shorter than a second period between a first puke of the second load signal and a second pulse of the second load signal, and the first period is longer than a third period between a first pulse of the third load signal and a second pulse of the third load signal.

7. A display apparatus, comprising:

a display panel comprising a plurality of gate lines, a plurality of data lines and a plurality of sub-pixels and being configured to display an image, the sub-pixels including a first color sub-pixel, a second color sub-pixel, a third color sub-pixel and a white sub-pixel, the first to the third color sub-pixels having different colors from each other;

a timing controller configured to generate a plurality of load signals including a plurality of low periods such that a load signal for the white sub-pixel has a different timing from at least one of the load signals for the first to the third color sub-pixels; and a data driver configured to generate data voltages synchronized to the low periods of the load signals and outputting the data voltages to the data lines.

8. The display apparatus of claim 7, wherein the first, the second and the third cc r sub-pixels are respectively red, green and blue sub-pixels, wherein the low periods include a first low period corresponding to the red sub-pixel, a second low period corresponding to the green sub-pixel, a third low period corresponding to the blue sub-pixel, and a fourth low period corresponding to the white sub-pixel, and the fourth low period is shorter than the second low period.

9. The display apparatus of claim 8, wherein the fourth low period is shorter than the first low period, and the second low period is longer than the first low period, and the third low period has a same length as the first period.

10. The display apparatus of claim 7, wherein the first, the second and the third color sub-pixels are respectively red, green and blue sub-pixels, wherein the display panel further comprises a first data line alternately connected to the red sub-pixel and the blue sub-pixel along a first direction and a second data line alternately connected to the green sub-pixel and the white sub-pixel along the first direction and adjacent to the first data line, wherein a first load signal corresponding to the first data line has a first low period corresponding to the red sub-pixel and a third low period corresponding to the blue sub-pixel and having a same length as the first period, and a second load signal corresponding to the second data line has a second low period corresponding to the green sub-pixel and a fourth low period corresponding to the white sub-pixel and being shorter than the second low period.

11. The display apparatus of claim 7, wherein the first, the second and the third color sub-pixels are respectively red, green and blue sub-pixels, wherein the display panel further comprises:

a first data line alternately connected to the red sub-pixel and the blue sub-pixel along a first direction and a second data line alternately connected to the green sub-pixel and the white sub-pixel along the first direction and adjacent to the first data line; and a third data line alternately connected to the red sub-pixel and the blue sub-pixel along the first direction and adjacent to the second data line and a fourth data line alternately connected to the green sub-pixel and the white sub-pixel along the first direction and adjacent to the third data line, a top of the second data line is connected to the green sub-pixel, and a top of the fourth data line is connected to the white sub-pixel, wherein data voltages for the first data line and the third data line are synchronized to a first load signal, data voltages for the second data line are synchronized to a second load signal, data voltages for the fourth data line are synchronized to a third load signal, and the first load signal, the second load signal and the third load signal have different timings from one another.

12. The display apparatus of claim 11, wherein a first period between a first pulse of the first load signal and a second pulse of the first load signal is shorter than a second period between a first pulse of the second load signal and a second pulse of the second load signal, and the first period is longer than a third period between a first pulse of the third load signal and a second pulse of the third load signal.

13. The method of claim 1, wherein at least one of the load signals has a different time period from others of the load signals.

14. The method of claim 1, the load signals include periodic repeated square waves having a time cycle comprised of a high period and a low period, the high period for each of the load signals being identical in duration, the low period varying in duration.

15. The method of claim 1, wherein the load signals comprise:

a first load signal used to produce a first data voltage that is applied to a first data line and not a second data line; and a second and different load signal that produces a second and different data voltage that is applied to the second and different data line that is adjacent to the first data line.

16. The method of claim 15, further comprising:

receiving a multiplexed load signal from an external source; and demultiplexing the received multiplexed load signal into the plurality of load signals.

17. The display apparatus of claim 7, wherein at least one of the load signals has a different time period from the rest of the load signals.

18. The display apparatus of claim 7, the load signals include periodic repeated square waves having a cycle comprised of a high period and a low period, the high period for the load signals being identical in duration, the low period of the load signals having a duration that varies.

19. The display apparatus of claim 7, wherein the load signals comprise:

a first load signal used to produce a first data voltage that is applied to a first data line and not a second data line adjacent to the first data line; and a second and different load signal that produces a second and different data voltage that is applied to the second data line and is not applied to the first data line.

20. The display apparatus of claim 19, wherein the cycle period for the first and second load signals vary in duration due to differing durations in the low periods.

* * * * *